US008827825B2

(12) United States Patent
Kaufman

(10) Patent No.: US 8,827,825 B2
(45) Date of Patent: Sep. 9, 2014

(54) REMOVABLY ATTACHABLE GOLF TRAINING AIDS AND METHODS OF USE

(71) Applicant: Jacob Kaufman, West Bloomfield, MI (US)

(72) Inventor: Jacob Kaufman, West Bloomfield, MI (US)

( * ) Notice: Subject to any disclaimer, the term of this patent is extended or adjusted under 35 U.S.C. 154(b) by 0 days.

(21) Appl. No.: 13/729,419

(22) Filed: Dec. 28, 2012

(65) Prior Publication Data

US 2013/0123035 A1 May 16, 2013

Related U.S. Application Data

(63) Continuation of application No. 12/869,310, filed on Aug. 26, 2010, now Pat. No. 8,342,979.

(60) Provisional application No. 61/237,511, filed on Aug. 27, 2009, provisional application No. 61/251,954, filed on Oct. 15, 2009.

(51) Int. Cl.
*A63B 69/36* (2006.01)
*A63B 71/06* (2006.01)

(52) U.S. Cl.
CPC ..... *A63B 69/3617* (2013.01); *A63B 2071/0627* (2013.01); *A63B 2071/0625* (2013.01); *A63B 69/3685* (2013.01); *A63B 69/3635* (2013.01); *A63B 69/3632* (2013.01); *A63B 2071/0633* (2013.01)
USPC ..... 473/224; 473/236; 473/238; 473/242; 473/409

(58) Field of Classification Search
CPC ..... A63B 69/3632; A63B 69/3685; A63B 69/3635; A63B 69/3617; A63B 2071/0627; A63B 2071/0625; A63B 2071/0633
USPC ..... 473/219–257, 263, 264
See application file for complete search history.

(56) References Cited

U.S. PATENT DOCUMENTS

| | | | | | |
|---|---|---|---|---|---|
| 1,759,622 | A | * | 5/1930 | Kenney | 473/235 |
| 2,378,747 | A | * | 6/1945 | Berman et al. | 132/284 |
| 2,417,335 | A | * | 3/1947 | Westby | 132/278 |
| 2,499,285 | A | * | 2/1950 | Stimson | 132/248 |
| 2,670,209 | A | * | 2/1954 | Fay | 473/241 |
| 3,021,141 | A | | 2/1962 | Polsky et al. | |
| 3,058,477 | A | * | 10/1962 | Dewing | 132/284 |
| 3,194,564 | A | | 7/1965 | Swan | |
| 3,298,693 | A | | 1/1967 | Eisenberg | |
| 3,730,529 | A | | 5/1973 | Donofrio | |
| 3,844,569 | A | | 10/1974 | Swanson | |
| 3,912,277 | A | | 10/1975 | Pelz | |

(Continued)

*Primary Examiner* — Sebastiano Passaniti
(74) *Attorney, Agent, or Firm* — Gifford, Krass, Sprinkle, Anderson & Citkowski, P.C.

(57) ABSTRACT

Attachable systems and methods allow a golfer to 'zero in' on the desired striking zone or "sweet spot" of a club, including putters and non-putters. One or more guides are positionable relative to the desired striking zone, such that if a golf ball interacts with a guide during a swing, the guide provides aural or tactile feedback that the club has hit the ball outside of the desired striking zone. The device may include at least two guides, one positionable on one side of the desired striking zone and the other positionable on the other side of the desired striking zone. The device may comprise guides in the form of a tab or leaf pivotable from an up position when not in use to a down position for use. If the club head has a back side, a portion of the device may contact with the back side.

11 Claims, 4 Drawing Sheets

(56) References Cited

U.S. PATENT DOCUMENTS

| | | | | |
|---|---|---|---|---|
| 4,002,343 | A * | 1/1977 | Eckert | 473/251 |
| 4,025,078 | A | 5/1977 | Pelz | |
| D244,874 | S | 6/1977 | Lombardi | |
| 4,130,282 | A | 12/1978 | Pelz | |
| D256,710 | S | 9/1980 | Dusto | |
| 4,323,246 | A | 4/1982 | Nehrbas, Jr. | |
| 4,720,109 | A | 1/1988 | Kryter | |
| 5,135,228 | A | 8/1992 | Hawkins, Sr. et al. | |
| 5,135,229 | A | 8/1992 | Archer | |
| 5,441,268 | A | 8/1995 | Shier | |
| 5,478,078 | A | 12/1995 | Lee | |
| D367,909 | S | 3/1996 | Lee | |
| 5,595,543 | A | 1/1997 | Wolk | |
| 5,810,675 | A | 9/1998 | Weathers | |
| 5,820,477 | A | 10/1998 | Redkey et al. | |
| 5,924,935 | A | 7/1999 | Prewitt | |
| 5,961,392 | A | 10/1999 | Hillock et al. | |
| 6,450,903 | B1 | 9/2002 | Tate | |
| 6,464,596 | B1 | 10/2002 | Belding | |
| 6,729,966 | B1 | 5/2004 | Barelli et al. | |
| 6,776,727 | B1 | 8/2004 | Engdahl | |
| 6,780,119 | B1 | 8/2004 | Gankas | |
| 6,821,212 | B2 | 11/2004 | Fowler et al. | |
| 6,827,655 | B2 | 12/2004 | Burns | |
| 6,872,149 | B1 | 3/2005 | Devon | |
| 7,396,288 | B2 | 7/2008 | McLauhglin | |
| 7,556,569 | B1 | 7/2009 | Caserta | |
| 7,614,960 | B2 | 11/2009 | Miller et al. | |
| 8,342,979 | B2 * | 1/2013 | Kaufman | 473/224 |
| 2004/0195775 | A1 | 10/2004 | Goldsmith | |
| 2005/0205104 | A1 * | 9/2005 | Silva | 132/200 |
| 2008/0251094 | A1 * | 10/2008 | Wells et al. | 132/226 |

* cited by examiner

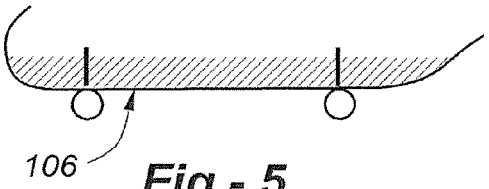
Fig - 5
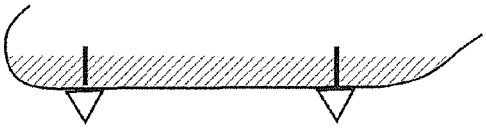
Fig - 6
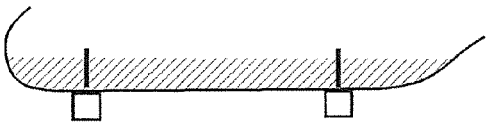
Fig - 7
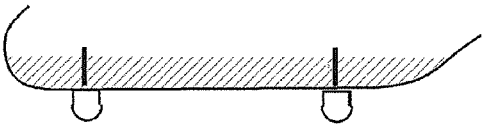
Fig - 8
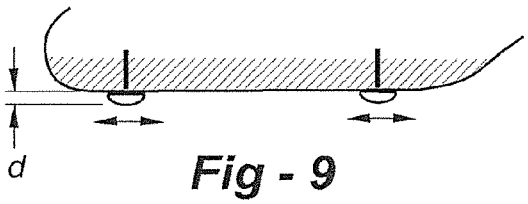
Fig - 9
Fig - 16
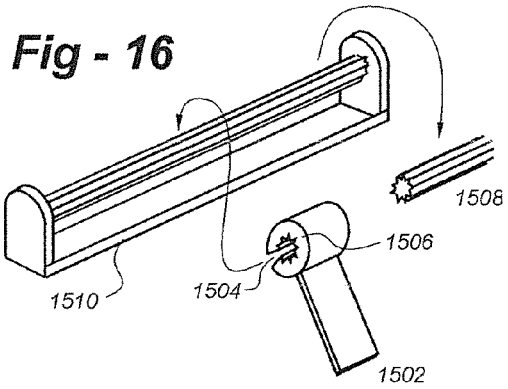

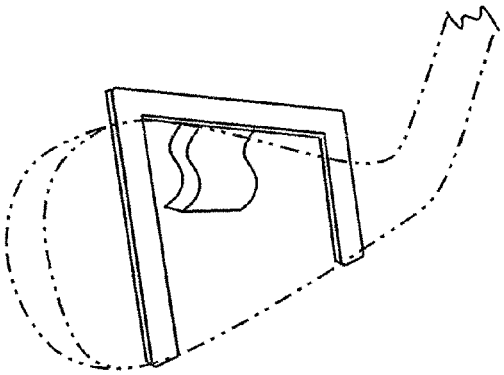
Fig - 10
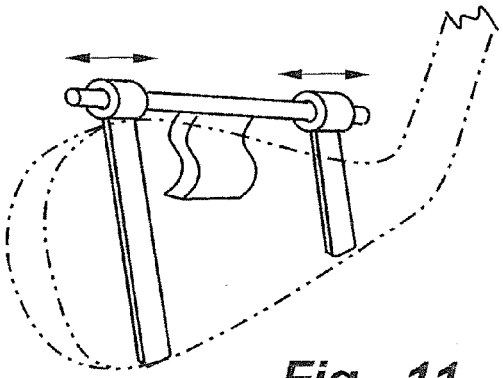
Fig - 11
Fig - 12
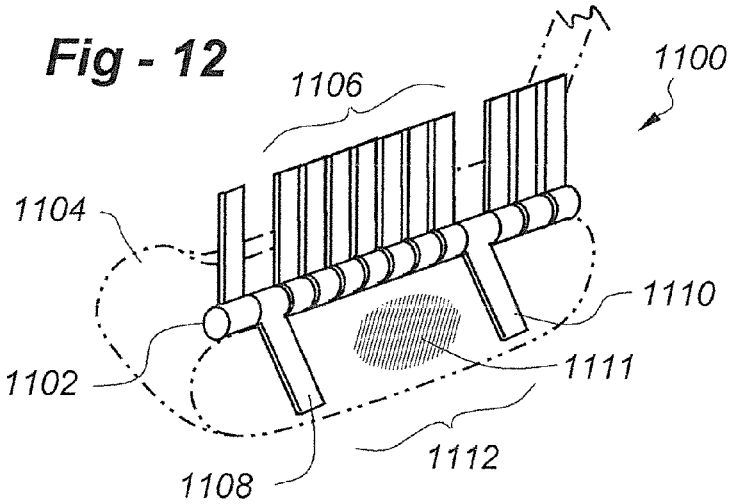
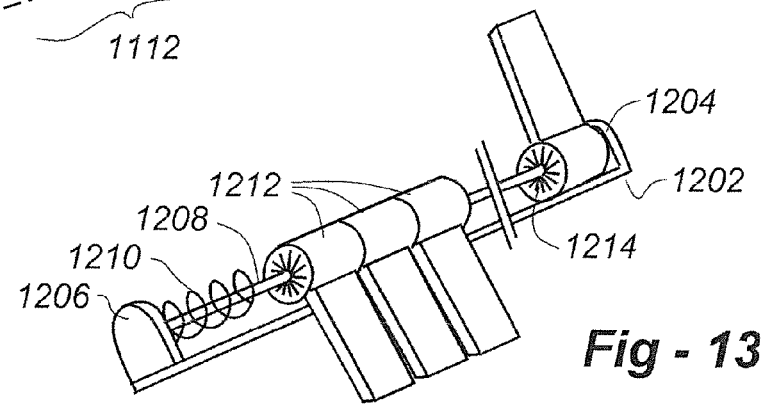
Fig - 13

REMOVABLY ATTACHABLE GOLF TRAINING AIDS AND METHODS OF USE

REFERENCE TO RELATED APPLICATIONS

This application is a continuation of U.S. patent application Ser. No. 12/869,310, filed Aug. 26, 2010, which claims priority from U.S. Provisional Patent Application Ser. Nos. 61/237,511, filed Aug. 27, 2009 and 61/251,954, filed Oct. 15, 2009, the entire content of each application being incorporated herein by reference.

FIELD OF THE INVENTION

This invention relates to golf. More particularly the invention relates to an attachable training aid and method for 'zeroing in' on the sweet spot.

BACKGROUND OF THE INVENTION

Many factors affect a golfer's ability to achieve a strong, solid impact on the ball. In terms of equipment, the way in which weight is distributed around the club head is an important consideration. Weight positioning affects the center of gravity of the club and is one factor that determines the "moment of inertia" or MOI of the club head. A high moment of inertia creates a more stable, solid hit and a club head that is less prone to twisting.

With regard to putting, in particular, many factors affect performance, including developing a good stroke and "reading the greens." But as with other clubs, it is important to hit the ball with the 'sweet spot' of the putter face. Regardless of putting stroke, reading the greens or practice, if the golfer strikes the ball off the sweet spot of the putter face, consistently good results will not be achieved. Putts struck with anything other than the sweet spot may cause putter-face rotation or wobble and, as a consequence, less energy will be imparted to the ball and/or it will roll offline The rotation may be so minimal that the golfer is not even aware of it, though wobble may lead to a slight vibration in the golfer's hands.

Moving weight to the different places also can make the "sweet spot" larger. A larger sweet spot means a larger hitting area which translates to more solid contact and greater distance. However, to maintain a proper swing weight (the perceived heaviness of the club), the overall weight of the head must remain about the same. Thus, to achieve a larger sweet spot, mass from behind the face must be taken out and moved to the perimeters of the club. This process creates an empty cavity behind the face and led to the name "cavity back" iron.

Putting extra weight out at the heel, sole, top line and the toe is the major factor in creating a larger MOI and more forgiveness. This design, called perimeter weighting, has been a game-improver for many high handicap golfers, with fewer golfers using the harder to hit "blade" style clubs.

With a thick top line, balls hit high on the club face will still be solid and maintain proper distance. A wide sole may create a lower center of gravity, thereby achieving a higher shot. A wider sole also has less of a tendency to dig into the turf, leading to fewer "fat shots." A wide sole also has a better chance of getting through rough and the sand.

Even with relativity recent improvements such as perimeter weighting, the face of any club head includes an area considered to be the sweet spot for that club. Any device that would allow a golfer to consistently strike the ball in this area should improve performance, and would therefore be welcomed by the golfing community.

SUMMARY OF THE INVENTION

This invention improves upon golf ball striking by providing attachable systems and methods for 'zeroing in' on the desired striking zone or "sweet spot" of a club. The invention is applicable to both putters and non-putters, including irons.

In accordance with the invention, a training aid for a golf club having a ball-striking surface with a desired striking zone comprises a device that removably attaches to the golf club. The device includes a guide positionable relative to the desired striking zone, such that if a golf ball interacts with the guide during a swing, the guide provides aural or tactile feedback that the club has hit the ball outside of the desired striking zone.

The device may include at least two guides, one positionable on one side of the desired striking zone and the other positionable on the other side of the desired striking zone. The device may comprise guides in the form of a tab or leaf pivotable from an up position when not in use to a down position for use. If the club head has a back side, a portion of the device may contact with the back side. In particular, if the club is an iron with a rear cavity on the club head, a portion of the device may be received in the cavity to enhance stability, particularly during a swing.

A golf training method according to the invention comprises the steps of providing a golf training aid disclosed herein, and moving the guide closer to the desired striking zone over time as a user improves his or her swing.

BRIEF DESCRIPTION OF THE DRAWINGS

FIG. 5 shows the guides positioned against club face having round cross sections;

FIG. 6 shows the guides having triangular cross sections;

FIG. 7 shows guides having rectangular cross sections,

FIG. 8 illustrates the use of an irregular cross section;

FIG. 9 shows the guides with a shallow cross sectional dimension, 'd';

FIG. 10 shows the guides interconnected with a single back piece;

FIG. 11 shows the guides moved on a rail or other such fixture;

FIG. 12 illustrates a configuration with flip-up, flip-down guides;

FIG. 13 is a close-up perspective view of one fold-up-down mechanism;

FIG. 16 shows a guide with a slit.

DETAILED DESCRIPTION OF THE INVENTION

This invention improves upon golf ball striking by providing attachable systems and methods for 'zeroing in' on the sweet spot of a club. Systems for putters and non-putters are disclosed. Although more than two guides may be shown in some of the accompanying diagrams, it will be appreciated that two, and in some cases even one guide, may be used to carry out the invention.

Figure 1:
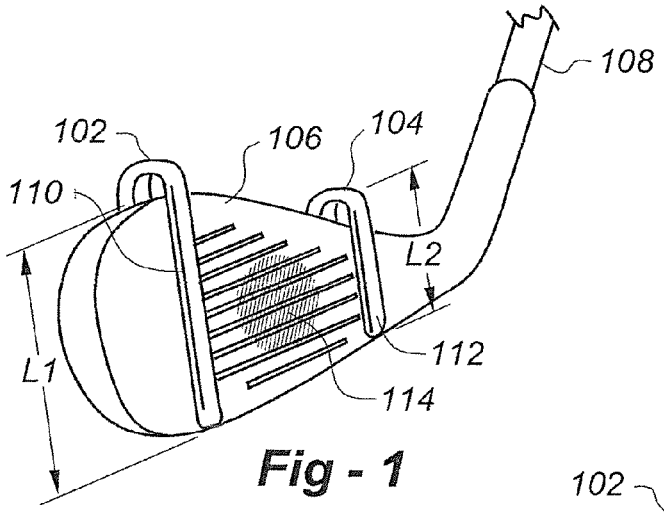
FIG. 1 illustrates a basic configuration constructed in accordance with the present invention.

FIG. 1 illustrates a basic configuration, wherein two devices 102, 104 are removably attached to the face 106 of a club head connected to shaft 108. In this case the devices 102, 104 provide guides 110, 112 that establish borders on either side of the sweet spot or preferred striking area 114. Note that the outer device 102 may have a length L1 that is greater that the length L2 of inner device 104.

Figure 2:
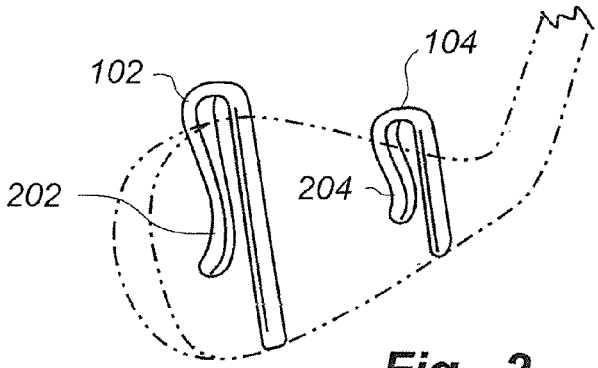
FIG. 2 shows a device in the form of clips.

The devices may be attached to the club head in various ways according to the invention. As shown in FIG. 2, the devices of FIG. 1 may be provided in the form of clips composed of a lightweight material such as plastic or spring steel. In this and the embodiment shown in FIG. 3, back sections 202, 204 may be configured to conform to the back surface of the club head. As such, different configurations may be used for different weight irons, "cavity back" and blade designs.

Figure 3:
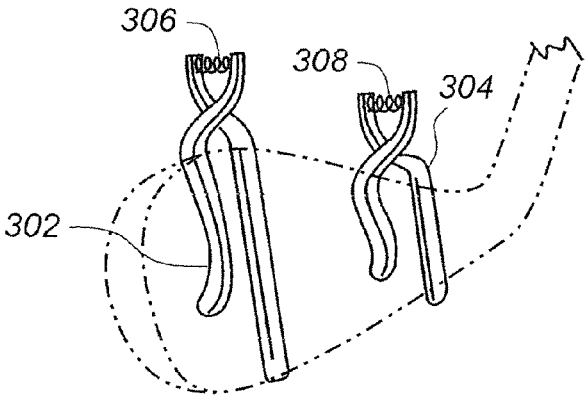
FIG. 3 shows a device utilizing spring-biased clips.
Figure 4:
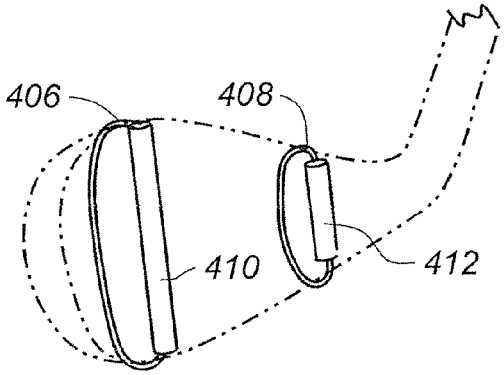
FIG. 4 shows guides attached with elastic bands.

As opposed to a passively springy design, scissor-like devices 302, 304 may be used as depicted in FIG. 3, with springs 306, 308 providing more active, potentially stronger levels of attachment power. As a further alternative, guides 410, 412 may attach to elastic bands 406, 408, as shown in FIG. 4, in which case the guides may be solid or hollow, with the bands being attached at both ends or journaled through each guide, respectively.

The use of two guides on either side of the club face allows the golfer to line up accurately with respect to the ball to achieve a straight shot. In addition, during the swing, if the ball contacts one of the guides it gives the golfer feedback that the swing was improper. Such feedback may be in the form of a sound or vibrations emitted by one of the guides or a clearly erroneous trajectory. For this reason, the material used to make the guides and the cross section of the guides may be important. In the preferred embodiments, plastic or metal may be used for some or all of the components parts. If two guides are used, particularly if different length or composition guides are used on each side of the "sweet spot," the configuration facilitates three different sounds and/or vibrational feedback modes; namely: (1) hitting too close to the toe; (2) hitting too close to the heel; and (3) hitting the desired zone (between the guides).

FIG. 5 shows guides 502, 504 positioned against club face 106 having round cross sections. FIG. 6 shows guides having triangular cross sections; FIG. 7 shows guides having rectangular cross sections, and FIG. 8 illustrates the use of an irregular cross section, in this case a generally square shape with a rounded forward section. These different shapes may be mixed and matched for any of the embodiments disclosed herein.

A distinct advantage of the invention is that the guides may be positioned in different places for different clubs and, indeed, they may be moved closely toward the center of the face as the golfer hone in on the sweet spot for a particular club over time. Thus a method according to the invention would involve the steps of positioning the guides at a first spaced-apart distance, then gradually moving the guides closer together over time as the skill of the golfer improves.

As shown in FIG. 9, guides with a shallow cross section 'd' would allow the guides to get closer to one another before interfering with the ball during a swing. The guides need not be positioned parallel to one another. The guides may be interconnected with a single back piece, as shown in FIG. 10, or they move on a rail or other such fixture, as shown in FIG. 11.

The devices described herein are preferably light weight so as not to alter the weight of the club. They may be colored, or differently colored to assist a user with correct swing visualization. The device may include advertising indicia. The devices may be used with any size or type of iron or putter, right-handed or left-handed. It may also be possible to adapt the system for use with woods through appropriate engineering modification.

Figure 15:
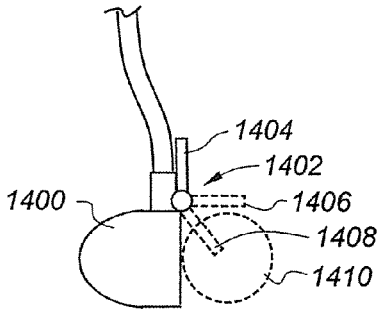
FIG. 15 shows a side view of the embodiment of FIG. 12.

FIG. 12 illustrates a configuration generally at 1100 having some form of base member 1102 attached to which there are a plurality of fold-down guides labeled 1106 In the illustration shown, two of the guides, 1108, 1110, have been folded down relative to the face of club 1104 to indicate a desired striking spot 1111 therebetween. This embodiment may be particularly useful for putters. As shown in the side view of FIG. 15, the guides 1402 are preferably moveable from an upright position 1402 to either/or a generally horizontal position 1406 which does not touch ball 1410 during a putt and is therefore useful as a visual guide only or, more preferably, to an angled downward position 1408 which the ball 1410 will hit if not struck as desired.

FIG. 13 is a close-up perspective view of one fold-up-down mechanism according to the invention. In this embodiment, the guides 1212 have holes and are supported on a rod 1208 disposed between end plates 1204, 1206. Each guide has side surfaces with radial indents 1214 which engage with intents on adjacent guides, enabling each guide to be positioned up/down as desired. A spring 1210 (which is compressed when assembled) keeps friction against the guides to keep them in place once set. Alternatively, dimples and divots or simply friction can be used to hold the guides in place.

Figure 14A:
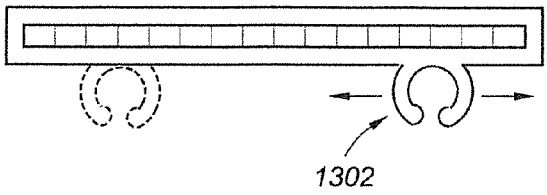
FIG. 14A shows a guide holder attachable to the shaft of a club.
Figure 14B:
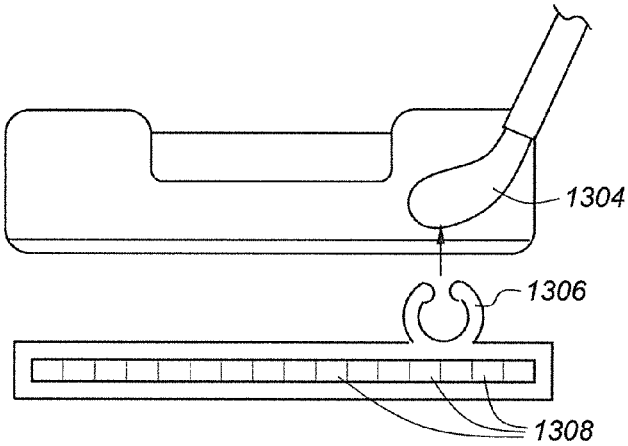
FIG. 14B shows the guide holder of FIG. 14A with a clip to attach to the shaft from a forward position.
Figure 14C:
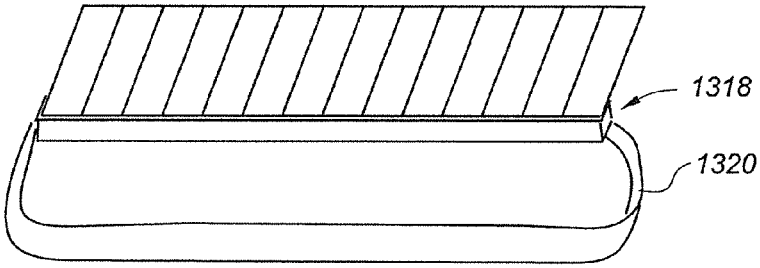
FIG. 14C shows the guide holder having an elastic band that goes around the perimeter of the club face.

The apparatus may also be attached to the shaft of a club as opposed to the club head. As shown in FIG. 14A, the guide holder may have a clip 1302 attached to the shaft 1304 of the club. The clip may be moveable back and forth as shown by the arrows to accommodate different club designs. As shown in FIG. 14B, the guide holder may have a clip 1306 to attach to the shaft from a forward position, thereby allowing all guides to be used without interfering with the shaft. The guide holder of FIG. 14A may have an additional clip 1310 so that it may be used either way. Alternatively, as shown in FIG. 14C, the guide holder 1318 may have an elastic band 1320 that goes around the perimeter of the club face. Any clip configuration may further include a thumb screw/set screw (1310) or other fastener for a more rigid attachment to the shaft or other club portion.

In alternative embodiments, the guides may be removable and translatable. For example, as shown in FIG. 16, a guide 1502 may have a slit 1504 leading to an internal serrated bore 1506 such that, when snapped over a rod 1508 featuring the same outer structure, the guide may be moved back and forth and up and down regardless of the number of guides mounted on the holder 1510.

I claim:

1. A golf training method, comprising the steps of:

providing a golf club having a shaft connected to a club head, the club head including a ball-striking surface with horizontal and vertical dimensions and a desired striking zone;

providing a training aid comprising: a pair of elongated guides that are removably attachable to the golf club head such that one of the guides is independently positionable at different, desired locations on one side of the desired striking zone and the other guide is independently positionable at different, desired locations on the other side of the desired striking zone; each guide having a back surface positionable vertically against the ball-striking surface and a forward edge facing away from the ball-striking surface; each guide having a length that generally corresponds to the vertical dimensions of the ball-striking surface of the club head either adjacent the heel or adjacent the toe; and each guide being constructed of a material that provides aural or tactile feedback if that guide interacts with a golf ball during a swing of the golf club;

attaching the training aid to the golf club head;

swinging the golf club towards a golf ball while the training aid is attached to the golf club head, wherein, if the golf ball interacts with the forward edge of one of the guides during a swing, that guide provides different aural or tactile feedback based on the material and length of the training aid, indicating that the ball-striking surface has hit the ball either too close to the toe or too close to the heel and outside of the desired striking zone; and wherein the guides are capable of being moved closer to the desired striking zone over time as a user improves his or her swing.

2. The golf training method of claim 1, wherein the guides are hollow cylinders that attach to the golf club with elastic bands.

3. The golf training method of claim 1, including two guides of different lengths to produce a different sound or vibrational sensation upon contact with a golf ball during a swing.

4. The golf training method of claim 1, wherein a portion of each guide contacts with the back side of the golf club head.

5. The golf training method of claim 1, wherein each guide is cylindrical or partially cylindrical.

6. The golf training method of claim 1, wherein the cross section of each guide is triangular, such that the forward edge is a line.

7. The golf training method of claim 1, wherein the cross section of each guide is rectangular, such that the forward edge is a flat surface.

8. The golf training method of claim 1, wherein the forward edge of each guide is rounded.

9. The golf training method of claim 1, including the step of moving one or both of the guides closer to the desired striking zone over time as a user improves his or her swing.

10. The golf training method of claim 1, including the step of providing guides that are made of metal.

11. The golf training method of claim 1, including the step of providing guides that are made of plastic.

* * * * *